US010080476B2

(12) United States Patent
Dirschus et al.

(10) Patent No.: US 10,080,476 B2
(45) Date of Patent: Sep. 25, 2018

(54) CLEANING APPARATUS WITH ILLUMINATED DOOR HANDLE

(71) Applicant: MEIKO Maschinenbau GmbH & Co. KG, Offenburg (DE)

(72) Inventors: Jürgen Dirschus, Schutterwald (DE); Bruno Gaus, Offenburg (DE); Thomas Peukert, Bühl (DE); Hans-Josef Rauber, Oberhamersbach (DE); Michael Wendt, Sasbach (DE)

(73) Assignee: MEIKO MASCHINENBAU GMBH & CO. KG, Offenburg (DE)

( * ) Notice: Subject to any disclaimer, the term of this patent is extended or adjusted under 35 U.S.C. 154(b) by 156 days.

(21) Appl. No.: 14/888,938

(22) PCT Filed: May 6, 2014

(86) PCT No.: PCT/EP2014/059171
§ 371 (c)(1),
(2) Date: Nov. 3, 2015

(87) PCT Pub. No.: WO2014/180814
PCT Pub. Date: Nov. 13, 2014

(65) Prior Publication Data

US 2016/0051124 A1 Feb. 25, 2016

(30) Foreign Application Priority Data

May 7, 2013 (DE) ..... 10 2013 208 374

(51) Int. Cl.

| | |
|---|---|
| ***A47L 15/42*** | (2006.01) |
| ***D06F 39/00*** | (2006.01) |
| ***A47L 15/00*** | (2006.01) |

(52) U.S. Cl.
CPC ..... *A47L 15/4293* (2013.01); *A47L 15/0092* (2013.01); *A47L 15/4257* (2013.01); *D06F 39/005* (2013.01)

(58) Field of Classification Search
CPC ..... A47L 15/4293; A47L 15/0092; A47L 15/4257; D06F 39/005; B08B 7/00; B08B 7/04
See application file for complete search history.

(56) References Cited

U.S. PATENT DOCUMENTS 3,619,592 A * 11/1971 Lamb, Jr. ..... A47L 15/4257 134/57 D
7,651,232 B2 * 1/2010 Baumgartner ..... A47L 15/4246 362/652

(Continued)

FOREIGN PATENT DOCUMENTS

CN 1750784 A 3/2006
CN 2902181 Y 5/2007

(Continued)

OTHER PUBLICATIONS

International Search Report issued in related International Patent Application No. PCT/EP2014/059171, completed Sep. 12, 2014.

(Continued)

*Primary Examiner* — Rita P Adhlakha
(74) *Attorney, Agent, or Firm* — Foley & Lardner LLP

(57) ABSTRACT

A cleaning apparatus for cleaning articles is proposed. The cleaning apparatus comprises a cleaning chamber for receiving the articles. The cleaning apparatus has at least one application device for applying at least one cleaning fluid to the articles in the cleaning chamber. The cleaning apparatus has at least one door for opening the cleaning chamber and for loading and unloading the cleaning chamber with articles. The door has at least one at least partially transparent handle. The cleaning apparatus has at least one illumi- (Continued)

nating device. The illuminating device is designed to illuminate the handle at least partially and illuminate the cleaning chamber and/or an inner side of the door in an opened state of the door.

5 Claims, 3 Drawing Sheets

(56) References Cited

U.S. PATENT DOCUMENTS

| | | | | |
|---|---|---|---|---|
| 8,810,423 | B2 | 8/2014 | Kaczmarek et al. | |
| 2005/0120492 | A1* | 6/2005 | Koo | D06F 37/304 8/159 |
| 2007/0180869 | A1* | 8/2007 | Geyer | D06F 39/005 68/196 |
| 2008/0106429 | A1* | 5/2008 | Kaczmarek | A47L 15/4257 340/679 |
| 2010/0033949 | A1 | 2/2010 | Hering et al. | |
| 2010/0147338 | A1* | 6/2010 | Busing | A47L 15/4293 134/56 D |
| 2014/0352077 | A1* | 12/2014 | Leitert | D06F 39/003 8/137 |
| 2016/0045095 | A1* | 2/2016 | Gleixner | A47L 15/4246 134/115 R |

FOREIGN PATENT DOCUMENTS

| | | | |
|---|---|---|---|
| CN | 101277639 | A | 10/2008 |
| CN | 101657136 | A | 2/2010 |
| DE | 10 2004 062 751 | A1 | 7/2006 |
| DE | 10 2004 062 752 | A1 | 7/2006 |
| DE | 10 2005 028 335 | A1 | 12/2006 |
| DE | 10 2005 047 914 | A1 | 4/2007 |
| DE | 10 2007 017 273 | A1 | 10/2008 |
| DE | 20 2008 013 564 | U1 | 4/2010 |
| DE | 10 2008 043 350 | A1 | 5/2010 |
| DE | 10 2010 003 103 | A1 | 9/2011 |
| EP | 0 691 100 | A1 | 5/1999 |
| EP | 2 394 557 | A2 | 12/2011 |
| EP | 2 543 307 | A1 | 1/2013 |
| JP | 2003-28433 | A | 1/2003 |

OTHER PUBLICATIONS

International Preliminary Report on Patentability for International Patent Application No. PCT/EP2014/059171, completed Nov. 12, 2015.

Notice of Reasons for Rejection issued in related Japanese Patent Application No. 2016-512336, dated Jan. 16, 2018.

Office Action issued in related Chinese Patent Application No. 201480034619.2, dated Oct. 19, 2017 and machine English translation.

* cited by examiner

CLEANING APPARATUS WITH ILLUMINATED DOOR HANDLE

CROSS-REFERENCE TO RELATED APPLICATIONS

This application is the National Phase of International Patent Application No. PCT/EP2014/059171, filed May 6, 2014, published as WO 2014/180814, which claims priority from German Patent Application No. 10 2013 208 374.2, filed May 7, 2013. The contents of these applications are incorporated herein by reference in their entirety.

FIELD OF THE INVENTION

The invention relates to a cleaning apparatus and to a method for cleaning articles. Such cleaning apparatuses and methods are used in particular in the area of dishwashing equipment for large-scale kitchens of company canteens, hospitals, care homes, public authorities, schools or universities or in commercial enterprises, such as restaurants or bars, for cleaning articles. The articles may be or comprise, for example, dishes, for example plates, cups, glasses, bowls, serving dishes, knives and forks and trays, and other articles that are used for the preparation and/or presentation and/or storing of food. A further area of use of the cleaning apparatus and the method may be in the area of cleaning care utensils, for example containers such as urine flasks or bedpans, that come into contact with human or animal excretions. In a further design, the cleaning apparatus and the method may be used to clean medical articles, for example medical containers or medical implements. In a further design, the cleaning apparatus and the method may be used for the cleaning of industrial containers, for example vats, bowls or buckets. Other areas of use are also conceivable in principle.

PRIOR ART

The prior art discloses a large number of cleaning apparatuses for cleaning various articles of various types. In particular, a large number of cleaning apparatuses with different illuminating devices and indicating devices are known. DE 10 2008 043 350 A1, DE 10 2010 003 103 A1 and DE 10 2007 017 273 A1 may be cited as examples.

In EP 0 691 100 A1, a description is given of such a cleaning apparatus in the form of a dishwashing machine. The dishwashing machine of the built-in type has a door which comprises at one edge of the door at least one luminous signaling device, which indicates operating states of the dishwashing machine. When the door is closed, the luminous signaling device is concealed by a housing of the dishwashing machine. In order to indicate operating states even when the door is closed, the light of the luminous signaling device is conducted to the front side of the door by an additional element in the door gap.

Prior-art cleaning apparatuses, in particular dishwashing machines, usually have an operator control panel that can only be discerned with difficulty by the operator or indications that are difficult to discern, particularly in the case of dishwashing machines of the built-in type and particularly in the case of those dishwashers known as undercounter machines, which are arranged well below the eye level of the operator. In the case of cleaning apparatuses that are of the built-in type, and are for example built in under a workshop or counter, discernibility of indications on the operator control panel is usually not optimal. Many possibilities for indicating operating states of dishwashing machines are known from the prior art.

For example, DE 10 2005 047 914 A1 discloses dishwashing machines that indicate not only individual operating states, but also lack of media by flashing patterns or flashing frequencies of various illuminating elements, for example on a side area of the dishwashing machine.

A further possibility for indicating operating states and/or operating parameters to an operator is disclosed in DE 10 2010 003 103 A1. A domestic appliance, for example a dishwashing machine, has a light source in a handle of a door of the domestic appliance that projects light onto an outer side of the door of the domestic appliance and in this way presents information.

The disadvantage of such an indication of operating states is that the operator control panel and the indications are difficult to discern unless the operator is directly in front of the cleaning apparatus. Therefore, in DE 10 2005 028 335 A1 a description is given of a dishwashing machine with an operator control unit that is arranged above a door and has downwardly directed light sources, for example white, single-colored or multi-colored light sources. The door also has a handle of transparent material. The light of the light sources is transmitted for example by light guides to the handle, so that in this way a certain operating state can be indicated. For example, operating states are indicated by way of light effects, in particular by way of combinations of different colors of light in different segments of the handle.

Furthermore, in DE 10 2004 062 752 A1 there is a description of a domestic appliance with an operating display that is formed over a large surface area and in each case indicates one of the operating states "operation", "end of program" and "off". The operating display has a luminous element that indicates the operating states by a steady light and flashing light or different flashing frequencies by colored light. The operating display is for example integrated in a handle of an appliance door of transparent material.

These known configurations of a door handle with an illuminated front area are disadvantageous, since the indications cannot be seen well by the operator if for example the operator is to the side of the cleaning apparatus. What is more, the known configurations of a door handle with an illuminated area are technically complex and usually have a short service life, because electric cables have to be led into the interior of the door.

Also known from the prior art is an illumination of the interior space of the dishwashing machine, in particular in the case of dishwashing machines of the built-in type, particularly in cases where exterior light conditions are poor, for example in bars or discotheques. In U.S. Pat. No. 3,619,592 there is a description of such a dishwashing machine, which has in a frame above a door of the dishwashing machine a fluorescent tube that illuminates the interior space of the dishwashing machine when the door is open and illuminates an operating button when the door is closed. However, a disadvantage of this arrangement is that this arrangement can be used almost exclusively for illuminating purposes and the possibility of indicating different operating states is greatly limited. What is more, the construction described is technically complex and sensitive to mechanical loads and loads that always occur in the area of dishwashing machines as a result of moisture and steam.

OBJECT OF THE INVENTION

The object of the present invention is therefore to provide a cleaning apparatus and a method for cleaning articles that at least largely avoid the disadvantages of known apparatuses and methods. In particular, the intention is to make it possible for an operator of the cleaning apparatus to clearly discern an operating state and other indications of the cleaning apparatus, and thus to facilitate operation of the cleaning apparatus and allow malfunctions in operation, such as for example an interruption in a dishwashing operation or a program step of a dishwashing operation or a lack of a medium, to be identified easily and reliably.

DISCLOSURE OF THE INVENTION

This object is achieved by a cleaning apparatus and a method for cleaning articles with the features of the independent patent claims. Advantageous developments of the invention, which can be realized individually or in any combination, are presented in the dependent claims.

Hereinafter, the terms "have", "comprise" or "include", or any grammatical variations thereof, are used in a non-exclusive way. Accordingly, these terms may denote both situations in which there are no further features apart from the features introduced by these terms or situations in which one or more further features are present. For example, the expression "A has B", "A comprises B" or "A includes B" may refer both to situations in which, apart from B, no further element is present in A (i.e. to a situation in which A consists exclusively of B) and the situation in which, in addition to B, one or more further elements are present in A, for example element C, elements C and D or even further elements.

In a first aspect, a cleaning apparatus for cleaning articles is proposed. A cleaning apparatus is to be understood as meaning an apparatus which is designed to remove at least largely contaminants that adhere to and/or are contained in the article. For example, this cleaning apparatus may be a dishwashing machine, which may for example be designed according to the aforementioned prior art, with the additional features according to the invention that are described below. A different design is also possible in principle.

Articles are to be understood in principle as meaning any article or plurality of articles that is/are to undergo one or more cleaning steps. In particular, the article(s) may comprise one or more articles selected from the group consisting of: dishes, knives and forks, other articles that are suitable for the preparation, processing, storage or presentation of meals and/or beverages, and care utensils, such as for example containers for receiving human excretions. However, other articles are also possible in principle. Accordingly, the cleaning apparatus may in particular be selected from a dishwashing machine, a glass washing machine and a tray washing machine. A design of the cleaning apparatus as a cleaning apparatus for cleaning containers for receiving human excretions, in particular as a cleaning and disinfecting unit and/or as a bedpan washer, is also possible. Other designs are also possible.

The cleaning apparatus comprises a cleaning chamber for receiving the articles. The cleaning chamber may in particular be a closed chamber, which is completely surrounded by a housing. Cleaning apparatuses with multiple chambers are also possible. However, single-chamber cleaning apparatuses, for example single-chamber dishwashing machines, are preferred.

The cleaning apparatus has at least one application device for applying at least one cleaning fluid to the articles in the cleaning chamber. Within the scope of the present invention, an application device is to be understood as meaning a device with which a liquid can be applied to the articles, for example by spraying, sprinkling or jetting or a combination of the manners of application mentioned and/or in some other way. For example, the application device may have at least one nozzle and/or at least one spraying arm for the application. The nozzle and the spraying arm may have at least one opening, for example at least one spraying opening or a plurality of spraying openings, through which the liquid can enter the cleaning chamber.

A cleaning fluid is to be understood in principle as meaning any fluid, in particular any liquid or combination of liquids, that can provide a cleaning effect. In particular, the cleaning fluid may be or comprise a cleaning liquid, for example an aqueous cleaning liquid, for example water, and/or an aqueous cleaning liquid with one or more additives, such as for example a cleaning agent concentrate and/or a rinse aid. Generally, various types of cleaning fluids may also be used, for example in parallel or sequentially.

Furthermore, the cleaning apparatus has at least one door for opening the cleaning chamber and for loading and unloading the cleaning chamber with articles. For example, the cleaning chamber may have at least one opening, for example an opening on a front side and/or on an upper side of the cleaning chamber, through which articles can be introduced into the interior of the cleaning chamber and which can be closed by the at least one door. Alternatively or in addition, the opening may also only be created by a movement of the door, such as is the case for example with a hood, in which case the hood itself may act as a door. The door is to be understood in principle as meaning any device for opening and/or closing the cleaning chamber. The door may in particular be selected from the group consisting of: a flap, in particular a hinged door located on a front side of the cleaning apparatus, preferably a downwardly opening hinged door; a flap arranged on an upper side of the cleaning apparatus; a sliding door; a hood, in particular an upwardly openable hood.

The door has at least one, at least partially transparent, handle. At least partially transparent is to be understood as meaning that at least part of the handle has a transparency to light at least of one wavelength. For example, there may be a transparency of at least 5%, preferably at least 10%, at least 20% or particularly preferably at least 50% to light of at least one wavelength. If the handle is only partially transparent, the handle may for example have at least one transparent region and at least one nontransparent region. Alternatively, the handle may also be designed completely as a transparent handle.

A handle of the door is to be understood generally as meaning a component with which the door can be opened, for example by an operator being able to grasp the handle with a hand. In particular, the handle may be designed as a protruding handle, in order in this way to ensure good visibility of the handle. In particular, good visibility for an operator who is to the side or at some distance from the machine can be ensured. For example, the handle may be designed in the form of a knob, a bar, as a strip or as a cup-shaped handle, in particular as a shell-shaped handle. In particular, the handle may have a round form. With particular preference, the handle may have a form of a knob. A design as a knob-like form is particularly advantageous, since the handle can be easily operated both with the right hand and with the left hand, and easy, effortless operation with wet hands is also possible. However, other designs are also possible.

Furthermore, the handle may be designed to allow an operator to reach with the fingers into the handle. For example, an undercut may be formed on part of a peripheral surface of the handle. An undercut may be understood for example as meaning an arrangement in which a cavity that is completely or partially concealed by the handle, at least with respect to an observer standing in front of the cleaning apparatus, is arranged behind the handle or behind part of the handle. This cavity may for example be open at the side, so that for example it is possible to reach laterally into the cavity. For example, part of the peripheral surface, in particular at least 25%, preferably 35%, particularly preferably half of the peripheral surface, may be set back, so as to produce a cavity in the form of a depression and/or a recess, into which an operator can reach with his or her fingers. Such a form allows the handle to be ergonomically grasped and actuation of the door to be facilitated.

Furthermore, the handle may be produced entirely or partially from a material that is resistant to commonly occurring foods and cleaning chemicals. The handle may be at least partially produced from a transparent material. The handle may for example be at least partially produced from glass. At least partially produced from glass is to be understood as meaning that at least part of the handle is produced from glass. For example, at least 50%, preferably at least 70%, or particularly preferably at least 80% of the handle may be produced from glass. Production from glass is particularly advantageous from aspects of hygiene.

Furthermore, the handle may be at least partially produced from transparent plastics material. At least partially produced from transparent plastics material is to be understood as meaning that at least part of the handle is produced from transparent plastics material. For example, the handle may be produced entirely or partially from polymethylmethacrylate.

For example, at least 50%, preferably at least 70%, particularly preferably at least 80% of the handle may be produced from transparent plastics material. When the handle is produced from plastics material, additives which prevent bacterial growth, for example by adding silver ions, may be added to the material.

The handle may be fastened to an outer wall of the door of the cleaning apparatus with non-positive engagement, for example by screwing, and/or with cohesive attachment, for example by adhesive bonding, and/or with positive engagement, for example by clipping in or with additional components, such as for example retaining springs. At the points at which the outer wall of the door is penetrated for the fastening of the handle, the door may be sealed off with respect to the handle, for example in a liquid-impermeable and/or vapor-impermeable manner. Fitting of the handle onto or into the door of the cleaning apparatus in such a way as to obtain a smooth surface and sealed finish is particularly advantageous, since the door with the fitted handle is thus insensitive to contamination and/or is easy to clean.

The cleaning apparatus has at least one illuminating device, which is designed to illuminate the handle at least partially. An at least partial illumination of the handle is to be understood as meaning that at least part of the volume of the handle is illuminated, while it is also possible in principle for unilluminated parts of the volume of the handle to exist. Furthermore, certain parts of the volume of the handle may be illuminated differently than other parts of the volume of the handle. In turn, alternatively or in addition, different parts of the volume of the handle may for example be illuminated sequentially or at different times. For example, generally at least 25%, preferably at least 50%, or particularly preferably at least 80% of the volume of the handle may be illuminated. Complete illumination of the handle is also possible.

The handle may in particular have a luminous area, for example a diffusely illuminating area. For example, a planar luminous area may be provided, for example in the form of a matt surface of the handle with diffusely light-scattering properties. For example, the luminous area may have a normal to the surface that points obliquely upward, that is to say a normal to the surface that has at least one directional component in the vertical direction. In this way an operator can easily discern the illumination of the handle even when the handle is arranged below a viewing height of an operator.

The handle may have a matt surface, at least in certain portions. A matt surface, at least in certain portions, is to be understood as meaning that the handle may have a matt surface in partial regions and may be designed as shiny in other partial regions. The matt surface regions in certain portions may be used as a projection screen. Furthermore, the handle may have at least one diffusor. For example, the handle may be at least partially produced from glass in the form of frosted glass, which is designed to make diffuse light emission possible. The handle may have at least one optical element for focusing and/or defocusing light. In particular, the handle may have one or more optical elements selected from the group consisting of a lens and a Fresnel lens. Furthermore, the material from which the handle is produced may be designed to allow light refraction and/or light deflection, for example by the addition of particles. Such a design of the handle is particularly advantageous to achieve an illumination of the handle that is as uniform as possible. Thus, an operator who is not looking at the cleaning apparatus from the front can discern an illumination of the handle.

An illuminating device is to be understood generally as meaning a device with at least one source of illumination, which may in principle be at least one light source of any kind. For example, the cleaning apparatus may comprise at least one semiconductor light source with at least one light-emitting diode, in particular a multicolor light-emitting diode. Alternatively or in addition, multiple light-emitting diodes each with a different color may also be provided. The source of illumination may be designed to emit light of different colors according to choice. It may thus also be possible to produce mixed colors and/or also color progressions.

Furthermore, the source of illumination may have a plurality of light sources of different emission properties. For example, at least one light source of the source of illumination may emit white light and at least one other may emit a colored light, and/or at least one light source may emit a colored light and at least one other light source may emit a light of a different color.

The illuminating device may be designed to emit at least two pulsed light signals with different pulse patterns. Pulsed light signals may be understood as meaning that the light from a light source is emitted for a limited time in pulses. A pulse pattern may be understood generally as meaning a variation over the time of the pulsed emission, for example characterized by a pulse width, a frequency, an on-off ratio or one or more other parameters. The illuminating device may be designed to flash in at least two different modes. For example, the illuminating device may emit light at time intervals of different lengths, for example in long pulses, for example of the order of magnitude of 0.5 s-10 s, in particular 1-2 seconds, or in short pulses, for example of the order of magnitude of a few milliseconds to several 100 milliseconds. The time intervals between two pulses may also be varied. Continuous operation of the at least one source of illumination or, if multiple sources of illumination are provided, at least one of the sources of illumination may also be provided.

Furthermore, the illuminating device may be designed such that, when the light source is switched on, a brightness does not immediately achieve a maximum brightness of the light source. In particular, the brightness may increase over time. Brightness is to be understood as meaning the amount of light radiated from the light source, in particular a radiation output. A maximum brightness is to be understood as meaning a maximum radiation output. For example, the brightness may increase to the maximum brightness over a time period, in particular a time period of 2 seconds, preferably a time period of 1.5 seconds, particularly preferably of 1 second.

Furthermore, the illuminating device may be designed such that, when the light source is switched off, there is not an immediate drop to a minimum brightness. The minimum brightness is to be understood as meaning a minimum radiation output, in particular no radiation output, of the light source. For example, the brightness may drop to the minimum brightness over a time period, in particular a time period of 2 seconds, preferably a time period of 1.5 seconds, particularly preferably of 1 second. Consequently a rising and falling effect can be achieved for example with respect to the luminous intensity.

The illuminating device may be selected from an illuminating device arranged in a housing of the cleaning apparatus and an illuminating device arranged in the door. The housing of the cleaning apparatus may be understood as meaning an outer protective enclosure of the cleaning apparatus. For example, the handle may be illuminated by the illuminating device directly or indirectly. Direct illumination of the handle is to be understood as meaning that the illuminating device is arranged in the door and the handle is radiated with light directly. Indirect illumination of the handle is to be understood as meaning that the illuminating device is arranged in the housing of the cleaning apparatus and the handle is not radiated with light directly.

The illuminating device may have at least one emission area at an edge of a housing of the cleaning apparatus that is facing the door, which may for example also be referred to as the exiting area or radiating area. An emission area is to be understood as meaning any area of the illuminating device that radiates the light emitted by the source or sources of illumination. Direct illumination of the handle is to be understood in this connection as meaning that the light radiated by the emission area illuminates the handle directly.

In the case of indirect illumination, the light radiated by the emission area does not illuminate the handle directly, but instead only impinges on the handle by deflection and/or reflection of the light and/or by conduction of the light. The light with which the handle is irradiated may be radiated from the surface or at least part of the surface of the handle, so that the surface or at least regions of the surface of the handle light up.

Furthermore, the illuminating device is designed to illuminate the cleaning chamber and/or an inner side of the door in an opened state of the door. An opened state of the door may be understood as meaning for example a partially opened state of the door or a fully opened state of the door, for example in a position for loading and unloading the cleaning chamber with articles.

The cleaning apparatus may be designed to couple light from the emission area into the handle according to choice or deflect it toward the cleaning chamber and/or toward the inner side of the door. For example, the cleaning apparatus may be designed to couple light from the emission area into the handle according to choice or deflect it in such a way that it is radiated into the interior of the cleaning chamber and/or toward an inner side of the door, so that for example an inner surface of the door can be completely or partially irradiated. The cleaning apparatus may comprise at least one reflector, which is designed to deflect light that is radiated by the illuminating device into the cleaning chamber. A reflector is to be understood in principle as meaning a reflective surface, for example a mirror. The reflector may be arranged on the inner side of the door. An arrangement at other locations of the housing of the cleaning apparatus is similarly conceivable.

In a preferred embodiment, the cleaning apparatus may be designed to couple light into the door in a closed state of the door. Furthermore, the cleaning apparatus may be designed to couple light into the handle when the door is closed and to deflect light toward the cleaning chamber when the door is open. Furthermore, the illuminating device may be designed to illuminate the handle at least partially in an opened state of the door.

Furthermore, the cleaning apparatus may comprise at least one optical waveguide, which is designed to transport light emitted by the illuminating device at least partially to the handle. An optical waveguide is to be understood generally as meaning any component in principle that is designed to transmit light, for example over a transmission path. For example, the optical waveguide may be based on the principle of internal total reflection. In particular, the optical waveguide may have at least one cable and/or at least one line for the transmission of light, for example one or more fibers of quartz glass or plastic, for example fiber-optic cables. Alternatively or in addition, the optical waveguide may also comprise one or more molded parts of plastic, for example one or more injection-molded transparent plastic molded parts. For example, one or more transparent plastic rods of any cross section in principle, in which a conduction of light from at least one entry area to at least one emission area takes place on the principle of an internal total reflection, may be provided.

The optical waveguide may be at least partially arranged in the door. Alternatively or in addition, however, the optical waveguide may also be arranged entirely or partially in a housing of the cleaning apparatus. For example, the source of illumination may be arranged in the housing and may be designed to radiate light into an entry area of the optical waveguide, it likewise being possible for the optical waveguide to be arranged entirely or partially in the housing and/or for the optical waveguide to be arranged entirely or partially in the door. A design in which at least one first optical waveguide is arranged in the housing and at least one second optical waveguide is arranged in the door is also possible. Thus, for example, the at least one first optical waveguide may conduct light from the source of illumination to an exit area of the first optical waveguide and radiate it there into an entry area of the second optical waveguide arranged in the door, for example when the door is in a closed state. The second optical waveguide may then for example conduct the light to the handle.

Furthermore, the illuminating device is designed to illuminate the cleaning chamber and/or the inner side of the door in an opened state of the door. An inner side may be understood for example as meaning at least one area or inner area of the door that is facing an interior of the cleaning chamber. The cleaning apparatus may for example comprise at least one reflector, which is designed to deflect light that is radiated by the illuminating device into the cleaning chamber. A reflector is to be understood in principle as meaning a reflective surface, for example a mirror. The reflector may in particular be arranged on an inner side of the door and/or may comprise at least one reflecting area of an inner side of the door. However, other designs are also possible in principle.

The cleaning apparatus may be designed to carry out a cleaning program. In the cleaning program, the cleaning fluid may be applied to the articles in at least one program step. The illuminating device may be designed to indicate at least one item of information about the cleaning program by means of a light signal. For example, information about the cleaning program may comprise an item of information about a cleaning program that has already ended or has just finished. Alternatively or in addition, the information may comprise an item of information about at least one cleaning program that has just been carried out or a cleaning program step that has just been carried out. The information about the cleaning program may be selected from the group consisting of: an item of information about abnormal running of the cleaning program, in particular an interruption of the cleaning program; an item of information about at least one current program step of the cleaning program; an item of information about at least one operating state of the cleaning apparatus; a warning about at least one faulty state of the cleaning apparatus, in particular a warning with respect to a faulty, missing or incorrect medium of the cleaning apparatus; an item of information about an unforeseen interruption of the cleaning program; an item of information about an unforeseen interruption of at least one program step of the cleaning program, including optionally an identification of the interrupted program step; an item of information about an unforeseen opening of the door during the course of the cleaning program; an item of information about an unforeseen opening of the door during the course of at least one program step of the cleaning program, including optionally an identification of the program step during the opening of the door; an item of information about an error-affected sequence of the cleaning program, an item of information about the inadequate fulfillment of predetermined parameters of the cleaning program, an item of information about an error-free sequence of the cleaning program, an item of information about the achievement of certain preset hygiene parameters, an item of information about the maintenance of certain preset procedural parameters of the cleaning program.

For example, the illuminating device may indicate blue-flashing light signals in a program step in which an operational readiness of the cleaning apparatus is being established, for example when filling or heating up the cleaning apparatus, while the illuminating device may for example indicate a continuous blue light signal when operational readiness has been established. Furthermore, the illuminating device may indicate green-flashing light signals during the sequence of the cleaning program, while the illuminating device may for example indicate a continuous green light signal after ending of the cleaning program. For issuing a warning, for example in the case of an interrupted program step, the illuminating device may for example indicate red light signals.

The illuminating device may indicate the at least one item of information about the cleaning program on the handle of the cleaning apparatus. The indication of the information on the handle is particularly advantageous because in this way an operator of the cleaning apparatus can easily discern an operating state of the cleaning apparatus and/or an error in the sequence of the cleaning program. Furthermore, the illuminating device may indicate the information about the cleaning program in an interior space of the cleaning chamber. Particularly preferred is an embodiment in which an illuminating device is designed to illuminate both the handle of the door and the cleaning chamber. The illuminating device may for example illuminate the interior space of the cleaning chamber with white light or with colored light. Color progressions from the colored light to white light are also possible. For example, the illuminating device may illuminate the interior space with red-flashing light signals, in order to indicate an opening of the door during a washing step or during a final rinse step. Opening of the door during drying could for example be indicated by green-flashing light signals. Normal opening of the door after ending of the cleaning program could for example be indicated by a color progression from green to white. If the door is left open, the illumination may be switched off. The period of time until the illumination is switched off may be stored in the control of the machine, for example by at least one parameter.

For controlling the illuminating device, the cleaning apparatus has at least one control. The control may comprise at least one data processing device, for example at least one processor, in particular a microcontroller. Furthermore, the control may have one or more interfaces, for example at least one user interface and/or at least one electronic interface. For example, the interface may comprise a keypad and/or an operator display, by way of which multiple parameters, such as for example the time until the interior space illumination is switched off, can be set.

Furthermore, the cleaning apparatus may have at least one display. The display is to be understood in general as meaning a component for indicating, for example, various states during the operation of the cleaning apparatus. For example, the display may be an electronic display, which can indicate information for example by LEDs of different colors. The display may for example be part of an operator control panel of the cleaning apparatus. The cleaning apparatus may be designed to present the at least one item of information about the cleaning program additionally on the display. For example the display may indicate at least to some extent the same information as the illuminating device and/or indicate information that is logically associated with the information indicated by the illuminating device. For example, the indications on the handle may be identical to the indications on the display. However, other designs are also possible. In principle, the cleaning apparatus may also be designed to switch off the illumination of the handle, so that the indication of the information only takes place by way of the display.

In a further aspect, a method for cleaning articles is proposed. The method uses at least one cleaning chamber for receiving the articles, in which at least one cleaning fluid is applied to the cleaning articles by means of at least one application device. The application device has at least one door for opening the cleaning chamber for loading and unloading the cleaning chamber with articles, the door having at least one at least partially transparent handle. The cleaning apparatus also has at least one illuminating device, by means of which the handle is at least partially illuminated. The illuminating device is also used in an opened state of the door for illuminating the cleaning chamber and/or an inner side of the door. A cleaning apparatus described in the first aspect of the invention may be used in the method. Accordingly, reference may be made to the description of the cleaning apparatus according to the invention for possible designs of the method. However, a different design is also possible in principle.

To sum up, within the scope of the present invention, the following embodiments are particularly preferred:

Embodiment 1

A cleaning apparatus for cleaning articles, comprising a cleaning chamber for receiving the articles, wherein the cleaning apparatus has at least one application device for applying at least one cleaning fluid to the articles in the cleaning chamber, wherein the cleaning apparatus has at least one door for opening the cleaning chamber and for loading and unloading the cleaning chamber with articles, wherein the door has at least one at least partially transparent handle, wherein the cleaning apparatus has at least one illuminating device, wherein the illuminating device is designed to illuminate the handle at least partially and wherein the illuminating device is designed to illuminate the cleaning chamber and/or an inner side of the door in an opened state of the door.

Embodiment 2

The cleaning apparatus according to the preceding embodiment, wherein the cleaning apparatus is selected from the group consisting of: a dishwashing machine; a tray washing machine; a cleaning apparatus for cleaning containers for receiving human excretions, in particular a cleaning and disinfecting unit and/or a bedpan washer.

Embodiment 3

The cleaning apparatus according to one of the preceding embodiments, wherein the door is selected from the group consisting of: a hinged door located on a front side of the cleaning apparatus, in particular a downwardly opening hinged door; a flap arranged on an upper side of the cleaning apparatus; a sliding door; a hood, in particular an upwardly openable hood.

Embodiment 4

The cleaning apparatus according to one of the preceding embodiments, wherein the illuminating device is designed to illuminate the handle at least partially in an opened state of the door.

Embodiment 5

The cleaning apparatus according to one of the preceding embodiments, wherein the illuminating device is selected from an illuminating device arranged in a housing of the cleaning apparatus and an illuminating device arranged in the door.

Embodiment 6

The cleaning apparatus according to one of the preceding embodiments, wherein the illuminating device is arranged in a housing of the cleaning apparatus, wherein the illuminating device is designed to couple light into the door in a closed state of the door.

Embodiment 7

The cleaning apparatus according to one of the preceding embodiments, wherein the illuminating device comprises at least one source of illumination, in particular at least one semiconductor light source.

Embodiment 8

The cleaning apparatus according to the preceding embodiment, wherein the semiconductor light source comprises at least one light-emitting diode.

Embodiment 9

The cleaning apparatus according to one of the two preceding embodiments, wherein the semiconductor light source comprises at least one multi-color light-emitting diode.

Embodiment 10

The cleaning apparatus according to one of the preceding embodiments, wherein the illuminating device is designed to emit light of different colors according to choice.

Embodiment 11

The cleaning apparatus according to the preceding embodiment, wherein the illuminating device has a plurality of light sources of different emission properties.

Embodiment 12

The cleaning apparatus according to one of the preceding embodiments, wherein the illuminating device is designed to emit at least two pulsed light signals with different pulse patterns.

Embodiment 13

The cleaning apparatus according to the preceding embodiment, wherein the illuminating device is designed to flash in at least two different modes.

Embodiment 14

The cleaning apparatus according to the preceding embodiment, wherein the illuminating device is designed such that, when the light source is switched on, a brightness does not immediately achieve a maximum brightness and, when the light source is switched off, there is not an immediate drop to a minimum brightness, wherein a rising and falling effect is achieved with respect to a luminous intensity.

Embodiment 15

The cleaning apparatus according to one of the preceding embodiments, wherein the cleaning apparatus is designed to carry out a cleaning program, wherein the cleaning fluid is applied to the articles in at least one program step of the cleaning program, wherein the illuminating device is designed to indicate at least one item of information about the cleaning program by means of a light signal.

Embodiment 16

The cleaning apparatus according to the preceding embodiment, wherein the information about the cleaning program comprises an item of information about the cleaning program that has already ended or has just finished.

Embodiment 17

The cleaning apparatus according to one of the two preceding embodiments, wherein the information about the cleaning program is selected from the group consisting of: an item of information about abnormal running of the cleaning program, in particular an interruption of the cleaning program; an item of information about at least one current program step of the cleaning program; an item of information about at least one operating state of the cleaning apparatus; a warning about at least one faulty state of the cleaning apparatus, in particular a warning with respect to a faulty, missing or incorrect medium of the cleaning apparatus; an item of information about an unforeseen interruption of the cleaning program; an item of information about an unforeseen interruption of at least one program step of the cleaning program, including optionally an identification of the interrupted program step; an item of information about an unforeseen opening of the door during the course of the cleaning program; an item of information about an unforeseen opening of the door during the course of at least one program step of the cleaning program, including optionally an identification of the program step during the opening of the door; an item of information about an error-free sequence of the cleaning program, an item of information about the maintenance of certain preset procedural parameters of the cleaning program, an item of information about the achievement of certain preset hygiene parameters, an item of information about an error-affected sequence of the cleaning program, an item of information about inadequate fulfillment of predetermined parameters of the cleaning program.

Embodiment 18

The cleaning apparatus according to one of the three preceding embodiments, wherein the cleaning apparatus also has at least one display, wherein the cleaning apparatus is designed to present the at least one item of information about the cleaning program additionally on the display.

Embodiment 19

The cleaning apparatus according to one of the preceding embodiments, wherein the handle is at least partially produced from glass.

Embodiment 20

The cleaning apparatus according to one of the preceding embodiments, wherein the handle is at least partially produced from a transparent plastics material.

Embodiment 21

The cleaning apparatus according to one of the preceding embodiments, wherein handle has a form of a knob.

Embodiment 22

The cleaning apparatus according to one of the preceding embodiments, wherein an undercut is formed on part of a peripheral surface of the handle.

Embodiment 23

The cleaning apparatus according to one of the preceding embodiments, wherein the handle has a round form.

Embodiment 24

The cleaning apparatus according to one of the preceding embodiments, wherein the handle has a matt surface, at least in certain portions.

Embodiment 25

The cleaning apparatus according to one of the preceding embodiments, wherein the handle has at least one diffusor for radiated light.

Embodiment 26

The cleaning apparatus according to one of the preceding embodiments, wherein the handle has at least one optical element for focusing and/or defocusing light, in particular an optical element selected from the group consisting of a lens and a Fresnel lens.

Embodiment 27

The cleaning apparatus according to one of the preceding embodiments, wherein the illuminating device has at least one emission area at an edge of a housing of the cleaning apparatus that is facing the door, wherein the cleaning apparatus is designed to couple light from the emission area into the handle according to choice or deflect it toward the cleaning chamber and/or toward the inner side of the door.

Embodiment 28

The cleaning apparatus according to the preceding embodiment, wherein the cleaning apparatus is designed to couple light into the handle when the door is closed and to deflect light toward the cleaning chamber when the door is open.

Embodiment 29

The cleaning apparatus according to one of the preceding embodiments, further comprising at least one optical waveguide, wherein the optical waveguide is designed to transport light emitted by the illuminating device at least partially to the handle.

Embodiment 30

The cleaning apparatus according to the preceding embodiment, wherein the optical waveguide is at least partially arranged in the door.

Embodiment 31

The cleaning apparatus according to one of the preceding embodiments, further comprising at least one reflector, wherein the reflector is designed to deflect light into the cleaning chamber.

Embodiment 32

The cleaning apparatus according to the preceding embodiment, wherein the reflector is arranged on an inner side of the door.

Embodiment 33

A method for cleaning articles, wherein at least one cleaning chamber for receiving the articles is used, at least one cleaning fluid is applied to the articles by means of at least one application device in the cleaning chamber, wherein the cleaning apparatus has at least one door for opening the cleaning chamber and for loading and unloading the cleaning chamber with articles, wherein the door has at least one at least partially transparent handle, wherein the cleaning apparatus has at least one illuminating device, wherein the handle is at least partially illuminated by means of the illuminating device and wherein the illuminating device is also used in an opened state of the door for illuminating the cleaning chamber and/or an inner side of the door.

Embodiment 34

The method according to the preceding embodiment, wherein a cleaning apparatus according to one of the preceding embodiments concerning the cleaning apparatus is used.

BRIEF DESCRIPTION OF THE FIGURES

Further details and features of the invention emerge from the following description of preferred exemplary embodiments, in particular in conjunction with the subclaims. The respective features may be realized here by themselves alone or together in combination with one another. The invention is not restricted to the exemplary embodiments. The exemplary embodiments are schematically represented in the figures. The same reference numerals in the individual figures thereby denote elements that are the same or functionally the same or correspond to one another with regard to their functions.

Specifically.

DESCRIPTION OF THE FIGURES

Figure 1A:
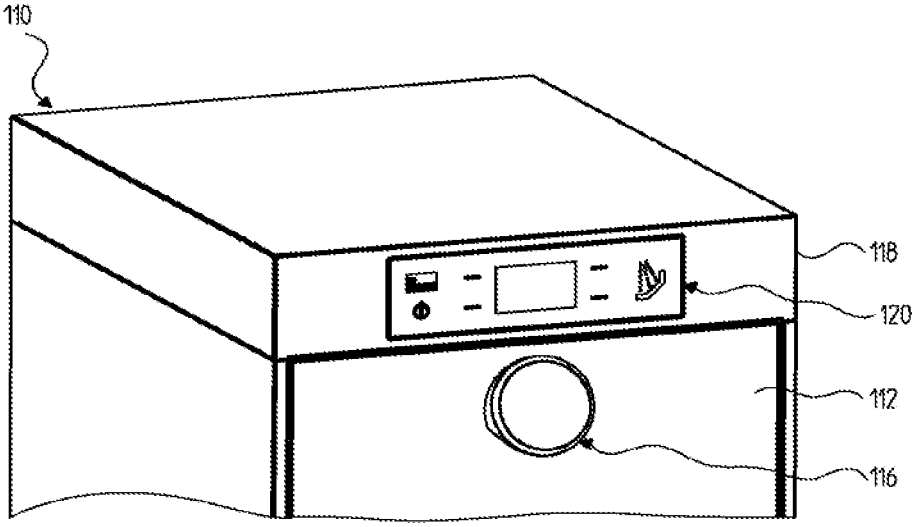
FIGS. 1A and 1B show a front view of a cleaning apparatus with a handle in the unilluminated state (FIG. 1A) and in the illuminated state (FIG. 1B)
Figure 1B:
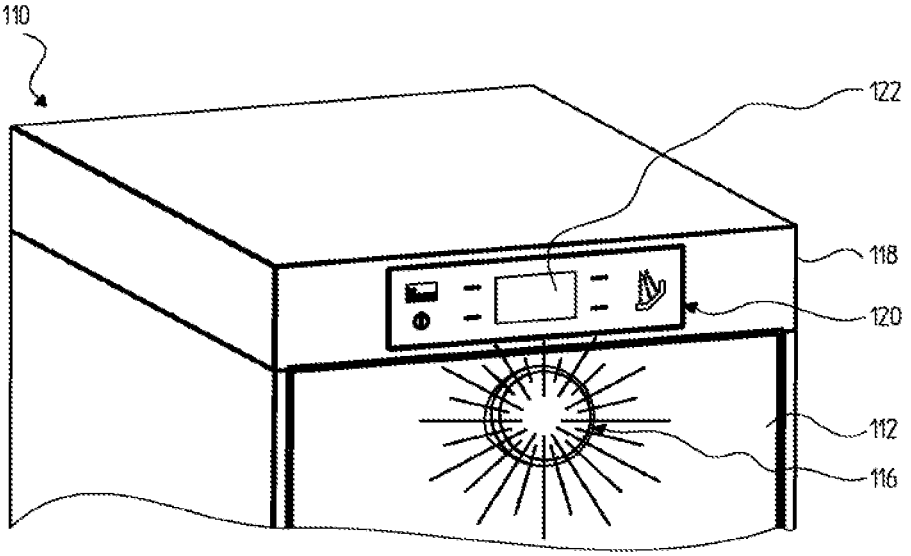

A front view of a cleaning apparatus 110 according to the invention is represented in FIGS. 1A and 1B. The cleaning apparatus 110 may for example be designed as a dishwashing machine, but some other design, for example as a tray washing machine, as a cleaning apparatus for cleaning containers for receiving human excretions, in particular as a cleaning and disinfecting unit and/or as a bedpan washer, are also possible in principle.

The cleaning apparatus 110 has a door 112, designed for example in the way represented as a front flap, in particular as a downwardly opening front flap. The door 112 may, however, also in principle be designed in some other way. For loading and unloading a cleaning chamber 114, which is shown for example in FIG. 2, with articles, the door 112 can be opened. The opening and/or closing of the door 112 may take place for example manually with a handle 116. The handle 116 may for example be designed as a round handle 116, for example in the form of a knob. The handle 116 may be fastened to the door 112 with non-positive engagement and/or with positive engagement and/or with cohesive attachment. The handle 116 may be produced from transparent material. For example, the handle 116 may be at least partially produced from glass and/or at least partially produced from transparent plastics material, for example frosted glass, in particular polymethylmethacrylate.

The cleaning apparatus 110 is designed to illuminate the handle 116. The handle 116 is shown in an unilluminated state in FIG. 1A and in an illuminated state in FIG. 1B. The handle 116 may have a matt surface in certain portions and/or at least one diffusor, in order to achieve an illumination of the handle 116 that is as uniform as possible. For example, the handle 116 may be designed as frosted or with a special finish. Furthermore, the handle may have at least one optical element for focusing and/or defocusing light, for example a lens and/or a Fresnel lens. Such a design is particularly advantageous because it allows the radiating angle of light at the handle 116 to be as wide as possible, in particular as far as possible 180°. This makes it possible that an operator looking at the handle 116 of the cleaning apparatus from the side can discern an operating state that is indicated on the handle 116.

The illumination of the handle 116 may be designed to indicate an item of information about an operating state of the cleaning apparatus 110. For example, information may be an item of information about abnormal running of a cleaning program. However, an indication of many other items of information about an operating state of the cleaning apparatus 110 is also possible.

Furthermore, the cleaning apparatus 110 may have a housing 118, which entirely or partially encloses the cleaning chamber 114. The housing 118 may close off the cleaning apparatus 110 with respect to the outside and protect it from external influences. On a front side of the housing 118, the cleaning apparatus 110 may have at least one operator control panel 120. This operator control panel 120 may be an interface with a control of the cleaning apparatus 110, by way of which an operator of the cleaning apparatus 110 can transfer parameters, for example a selection of a cleaning program, to the control. The operator control panel 120 may also comprise a display 122, in which at least one item of information about the cleaning program can be presented. For example, the information about the cleaning program may comprise an item of information about an operating state of the cleaning apparatus 110, for example an item of information about a cleaning program that has already ended or has just finished.

Figure 2:
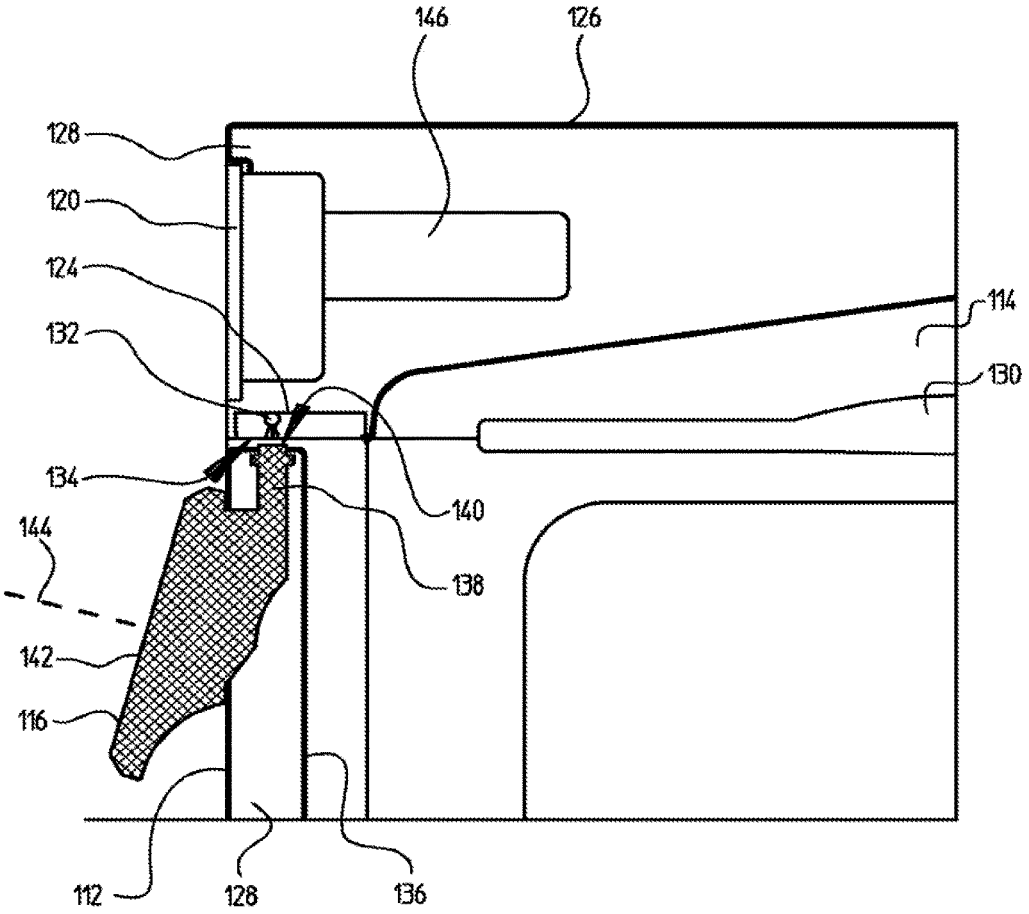
FIG. 2 shows a sectional representation of the cleaning apparatus according to FIGS. 1A and 1B.

FIG. 2 shows a sectional representation of the cleaning apparatus 110. The door 112 may for example be designed as a double-walled sheet-metal door, for example as a front flap. The cleaning apparatus 110 has an illuminating device 124. The illuminating device 124 is designed to illuminate the transparent handle 116 at least partially. The illuminating device 124 may be fitted in a cover 126 of the cleaning apparatus 110 in a fitting space 128, as represented in FIG. 2, and illuminate the handle 116 indirectly.

In this embodiment, the illuminating device 124 may be designed to couple light into the door 112 in a closed state of the door 112. Such an embodiment is advantageous because short cable routes are possible from the illuminating device 124 to the control of the cleaning apparatus 110, arranged for example in the cover 126 of the cleaning apparatus 110. Alternatively, the illuminating device 124 may be built into the door 112 in the fitting space 128 (this variant is not represented) and illuminate the handle 116 directly.

The illuminating device 124 may be designed to illuminate the handle 116 at least partially in an opened state of the door 112. The illuminating device 124 is also designed to illuminate the cleaning chamber 114 in an opened state of the door 112, for example during a loading or unloading of the articles. The cleaning chamber 114 comprises an application device 130 for applying at least one cleaning fluid to the articles. The cleaning fluid may be any cleaning liquid, for example water or water with chemical additives. The application device 130 may be designed in the form of a spraying arm. A different design, for example as at least one nozzle, is also possible in principle.

The illuminating device 124 may also comprise at least one source of illumination 132, for example at least one semiconductor light source, in particular at least one light-emitting diode. The at least one light-emitting diode may be designed as a white-light emitting light-emitting diode and/or as at least one multi-color light-emitting diode, in order to emit light of different colors according to choice. Particularly advantageous is a design of the source of illumination 132 with a plurality of light sources of different emission properties. In this way, the illuminating device 124 can indicate different colors and/or color progressions. Furthermore, the illuminating device 124 may be designed to emit the white and/or colored signals emitted by the source of illumination 132 in a pulsed manner. For example, the illuminating device 124 may emit at least two pulsed light signals with different pulse patterns; for example, the illuminating device 124 may flash in at least two different modes. It is in this way possible to indicate for example different operating states by different pulse patterns.

The cleaning apparatus 110 may generally have in this or in other exemplary embodiments for example at least one control 146, for example a control for carrying out one or more cleaning programs. The control 146 may for example comprise at least one data processing device. The control 146 may in particular also be designed to control the illumination of the handle 116, for example colors and/or time sequences of the illumination. In particular, the cleaning apparatus 110, for example by means of the control 146, may be designed to indicate by a corresponding illumination of the handle 116 at least one item of information about the cleaning program by means of at least one light signal. For example, the information about the cleaning program may be selected from the group consisting of: an item of information about abnormal running of the cleaning program, in particular an interruption of the cleaning program; an item of information about at least one current program step of the cleaning program; an item of information about at least one operating state of the cleaning apparatus 110; a warning about at least one faulty state of the cleaning apparatus 110, in particular a warning with respect to a faulty, missing or incorrect medium of the cleaning apparatus 110; an item of information about an unforeseen interruption of the cleaning program; an item of information about an unforeseen interruption of at least one program step of the cleaning program, including optionally an identification of the interrupted program step; an item of information about an unforeseen opening of the door 112 during the course of the cleaning program; an item of information about an unforeseen opening of the door 112 during the course of at least one program step of the cleaning program, including optionally an identification of the program step during the opening of the door 112; an item of information about an error-free sequence of the cleaning program, an item of information about the maintenance of certain preset procedural parameters of the cleaning program, an item of information about the achievement of certain preset hygiene parameters, an item of information about an error-affected sequence of the cleaning program, an item of information about inadequate fulfillment of predetermined parameters of the cleaning program. These various items of information may be transmitted for example by way of light signals of different types, it being possible for example for the light signals to be prescribed respectively for an item of information to be transmitted. For example, a corresponding list of which information is to be indicated by which light signal may be stored in the control 146, and the source of illumination 132 may be activated correspondingly.

The light signals of the source of illumination 132 may be emitted by an emission area 134 of the illuminating device 124 at an edge of a housing 118 of the cleaning apparatus 110 that is facing the door 112. The light emitted by the emission area 134 may be coupled into the handle 116 according to choice or be deflected toward the cleaning chamber 114. For example, when the door 112 is closed, the light may be coupled into the handle 116 directly and/or by way of at least one optical waveguide 138. The optional, at least one, optical waveguide 138 may for example be arranged entirely or partially in the door 112 and/or may also be arranged entirely or partially in the housing 118. The optical waveguide 138 may for example have at least one entry area 140, by way of which light of the source of illumination 132 can be coupled in directly or indirectly. The optical waveguide 138 may be designed in one piece with the handle 116, as represented in FIG. 2, or else it may be designed as a separate component.

The cleaning apparatus 110 is also designed in such a way that, when the door 112 is open, light of the source of illumination 132 can radiate onto an inner side of the door 112 and/or can be deflected into the cleaning chamber 114, for example by a reflector 136 in the inner side of the door 112. When a source of illumination 132 is fitted in the fitting space 128 in the cover 126 of the cleaning apparatus 110, light emitted by the emission area 134 can be at least partially transported to the handle 116, for example by the optical waveguide 138.

The handle 116 may for example have a luminous area 142. This luminous area 142 may be designed in particular as a diffusor and/or may in some other way have scattering properties, for example in that this luminous area 142 is designed as a matt surface of the handle 116. In particular, the luminous area 142 may be designed as a planar surface. It is particularly preferred if the luminous area 142 has a normal to the surface 144 that is not aligned perpendicularly in relation to the door 112 and preferably points obliquely upward when the door 112 is closed, that is to say with an upward directional component in the vertical direction. In this way it can be made easier for example for an operator to see the handle 116, and in particular the luminous area 142.

Figure 3:
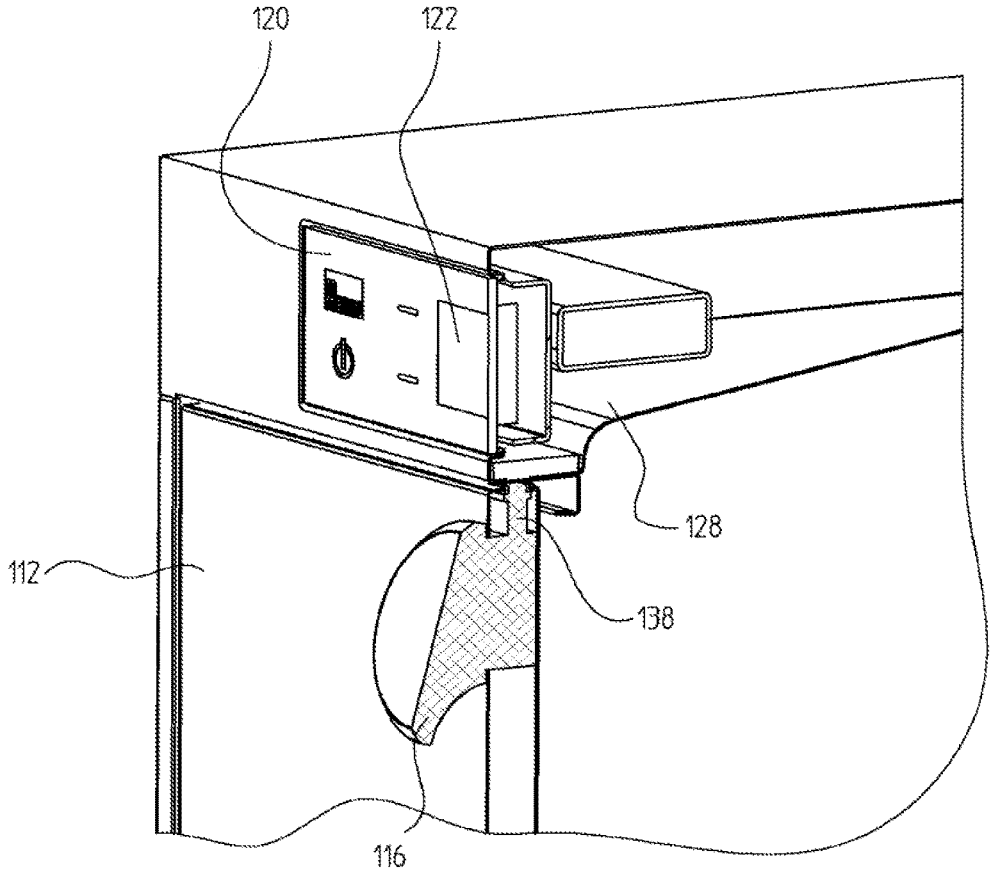
FIG. 3 shows a sectional representation of the cleaning apparatus with a fitting space in a cover of the cleaning apparatus.

FIG. 3 shows a sectional representation of the cleaning apparatus 110 with the fitting space 128 in the cover 126 and the handle 116 in the door that can be illuminated by the illuminating device 124 and the optical waveguide 138.

LIST OF REFERENCE NUMERALS

110 Cleaning apparatus
112 Door
114 Cleaning chamber
116 Handle
118 Housing
120 Operator control panel
122 Display
124 Illuminating device
126 Cover
128 Fitting space

130 Application device
132 Source of illumination
134 Emission area
136 Reflector
138 Optical waveguide
140 Entry area
142 Luminous area
144 Normal to the surface
146 Control

The invention claimed is:

1. A cleaning apparatus for cleaning articles, comprising:
a cleaning chamber configured to receive the articles;
at least one application device configured to apply at least one cleaning fluid to the articles in the cleaning chamber;
at least one door configured to open the cleaning chamber for loading and unloading the articles in the cleaning chamber, the door having at least one at least partially transparent handle; and
at least one illuminating device configured to illuminate the handle at least partially and to illuminate one or both of the cleaning chamber and an inner side of the door in an opened state of the door,
wherein the cleaning apparatus is configured to carry out a cleaning program,
wherein the cleaning fluid is applied to the articles in at least one program step of the cleaning program,
wherein the illuminating device is configured to indicate at least one item of information about the cleaning program on at least one of the handle and an interior space of the cleaning chamber via a light signal,
wherein the information about the cleaning program is selected from the group consisting of:
an item of information about abnormal running of the cleaning program;
an item of information about at least one current program step of the cleaning program;
a warning about at least one faulty state of the cleaning apparatus;
an item of information about an unforeseen interruption of the cleaning program;
an item of information about an unforeseen interruption of at least one program step of the cleaning program;
an item of information about an unforeseen opening of the door during a course of the cleaning program;
an item of information about an unforeseen opening of the door during a course of at least one program step of the cleaning program;
an item of information about an error-free sequence of the cleaning program;
an item of information about an achievement of certain preset hygiene parameters;
an item of information about maintenance of certain preset procedural parameters of the cleaning program;
an item of information about an error-affected sequence of the cleaning program; and
an item of information about inadequate fulfillment of predetermined parameters of the cleaning program.

2. The cleaning apparatus as claimed in claim 1,
wherein the information about the cleaning program is the item of information about abnormal running of the cleaning program, and
wherein the item of information about abnormal running of the cleaning program is an item of information about an interruption of the cleaning program.

3. The cleaning apparatus as claimed in claim 1,
wherein the information about the cleaning program is the warning about at least one faulty state of the cleaning apparatus, and
wherein the warning about at least one faulty state of the cleaning apparatus is a warning with respect to a faulty, missing or incorrect medium of the cleaning apparatus.

4. The cleaning apparatus as claimed in claim 1,
wherein the information about the cleaning program is the item of information about an unforeseen interruption of at least one program step of the cleaning program, and
wherein the item of information about an unforeseen interruption of at least one program step of the cleaning program includes an identification of the interrupted program step.

5. The cleaning apparatus as claimed in claim 1,
wherein the information about the cleaning program is the item of information about an unforeseen opening of the door during the course of at least one program step of the cleaning program, and
wherein the item of information about an unforeseen opening of the door includes an identification of the program step during the opening of the door.

* * * * *